US010662649B2

(12) United States Patent
Destouches

(10) Patent No.: US 10,662,649 B2
(45) Date of Patent: May 26, 2020

(54) PREFABRICATED CONSTRUCTION DEVICE, SETTING IN PLACE AND USAGE THEREOF

(71) Applicant: L. DESTOUCHES, Mettray (FR)

(72) Inventor: Laurent Destouches, Mettray (FR)

(73) Assignee: L. DESTOUCHES, Mettray (FR)

( * ) Notice: Subject to any disclaimer, the term of this patent is extended or adjusted under 35 U.S.C. 154(b) by 0 days.

(21) Appl. No.: 16/373,455

(22) Filed: Apr. 2, 2019

(65) Prior Publication Data

US 2019/0309516 A1 Oct. 10, 2019

(30) Foreign Application Priority Data

Apr. 9, 2018 (FR) ..... 18 53076

(51) Int. Cl.

| | |
|---|---|
| ***E04C 2/40*** | (2006.01) |
| ***E04B 2/18*** | (2006.01) |
| ***E04B 2/20*** | (2006.01) |
| ***E04B 2/72*** | (2006.01) |
| ***E04C 2/22*** | (2006.01) |
| ***E04C 2/36*** | (2006.01) |
| ***E04C 2/38*** | (2006.01) |
| ***E04B 2/92*** | (2006.01) |
| ***E04B 2/00*** | (2006.01) |
| *E04B 2/02* | (2006.01) |
| *E04C 2/34* | (2006.01) |

(Continued)

(52) U.S. Cl.

CPC ..... *E04C 2/40* (2013.01); *E04B 2/18* (2013.01); *E04B 2/20* (2013.01); *E04B 2/72* (2013.01); *E04B 2/92* (2013.01); *E04C 2/22* (2013.01); *E04C 2/36* (2013.01); *E04C 2/388* (2013.01); *E04C 2/48* (2013.01); *E04B 2002/0206* (2013.01); *E04B 2002/0295* (2013.01); *E04C 2/296* (2013.01); *E04C 2/34* (2013.01); *E04C 2/521* (2013.01); *E04C 2002/3488* (2013.01)

(58) Field of Classification Search

CPC ..... E04C 2/40; E04B 2/92; E04B 2/18; E04B 2/20; E04B 2/72

See application file for complete search history.

(56) References Cited

U.S. PATENT DOCUMENTS 5,465,545 A 11/1995 Trousilek
5,706,620 A * 1/1998 De Zen ..... E04B 1/12 52/220.2

(Continued)

FOREIGN PATENT DOCUMENTS

DE 28 45 334 A1 4/1980
EP 0 558 767 A1 9/1993

(Continued)

*Primary Examiner* — Babajide A Demuren

(74) *Attorney, Agent, or Firm* — Im IP Law; Chai Im; C. Andrew Im

(57) ABSTRACT

A construction element includes at least one module with a rectangular parallelepiped shape, hollow and made of a composite material. The module is delimited by an enclosure with four panels, two first opposing parallel panels and two second panels perpendicular to the first panels. The second panels include at least one groove parallel to the first panels. Each second panel is extended on one side by an L-shaped profile and on the other side by a flat profile. The profiles are elements protruding outwards, parallel to the groove.

12 Claims, 4 Drawing Sheets

(51) Int. Cl.
*E04C 2/52* (2006.01)
*E04C 2/296* (2006.01)

(56) References Cited

U.S. PATENT DOCUMENTS

| | | | | |
|---|---|---|---|---|
| 5,974,751 | A * | 11/1999 | De Zen | E04B 2/8629 52/439 |
| 8,033,759 | B2 * | 10/2011 | Davidsaver | E02B 3/06 405/284 |
| 10,287,773 | B2 * | 5/2019 | Taleb | E04B 2/8629 |
| 2003/0009963 | A1 * | 1/2003 | Crowell | E04B 1/12 52/270 |
| 2007/0175146 | A1 * | 8/2007 | Carlisle | E04B 2/8629 52/426 |
| 2010/0212241 | A1 | 8/2010 | Holroyd | |
| 2014/0190106 | A1 * | 7/2014 | Cetindag | E04B 2/18 52/309.13 |

FOREIGN PATENT DOCUMENTS

| | | | |
|---|---|---|---|
| FR | 3 011 863 | A1 | 4/2015 |
| WO | 2013/163700 | A1 | 11/2013 |
| WO | 2015/192179 | A1 | 12/2015 |

* cited by examiner

PREFABRICATED CONSTRUCTION DEVICE, SETTING IN PLACE AND USAGE THEREOF

RELATED APPLICATIONS

This application claims priority from French Patent Application No. 18 53076 filed Apr. 9, 2018, which is incorporated herein by reference in its entirety.

TECHNICAL FIELD OF THE INVENTION

The invention relates to a prefabricated construction device in particular for buildings, and of which the implementation makes it possible to create the wall, or more broadly the wall of a construction whereon is intended to be added an aesthetic and/or functional structure.

Without a limiting nature, the device of the invention relates to all types of buildings, individual or collective housing, tertiary or industrial buildings, floating buildings of the stationary housing type or ocean liners, etc.

In particular, the invention relates to a prefabricated construction device that makes it possible to create façades with high environmental performance, active of the energy recovery type, and with a low carbon footprint. Indeed, few materials are implemented and the latter are preferably with low grey energy. Furthermore, the use of bio-sourced insulation is possible. Moreover, the device of the invention is easy to vegetate.

Alternatively, this construction device can be used in the creation of floors, extending floors of the balcony type, but also structure roofing elements and roof-terraces.

The construction device of the invention reduces the overall cost of construction by procuring among other things a rapidity and a quality of implementation with a large place given to prefabricating in the factory, and a deployment on site that is very easy of prefabricated units.

BACKGROUND OF THE INVENTION

Current buildings are conventionally constructed using so-called "heavy", or "light" façades.

Heavy façades are created from masonry elements, in particular concrete that is cast on site, or prefabricated concrete modules. Prefabricated concrete modules generally have a height that corresponds to the height of one floor level. Once the modules are in place and assembled, are added against their outer face with respect to the outside environment a façade structure with an aesthetic and possibly thermal insulation function, and against their inner face a cladding structure that can furthermore be thermally and acoustically insulating.

Light façades are generally with a metal framework and cladding. Such façades are for example façades referred to as "curtain" which are formed of glass panels, or of façades with a wooden framework and panels.

These constructions are mostly too far from the objectives to be achieved in terms of environmental performance. This same notion of ecological efficiency is also too complex and expensive to be obtained with conventional construction methods.

Furthermore, conventional methods have many disadvantages such as:

- limited gains in productivity,
- many problems linked to implementation on a construction site: insufficient control of the quality (risks of pathologies), dequalification observed of the competences and methods (arduousness of the work on the construction site, demotivation of colleagues),
- architectural limitations, as the architectural expressions are often frozen,
- absence of satisfactory solutions for treating thermal bridges at the interfaces between the structure and singular points (balconies, loggias, projections, etc.) whether for thermal insulation via the inside or thermal insulation via the outside,
- recycling difficulties during a deconstruction (high environmental cost).

Moreover, among the sensitive points of a construction, façades represent a key element in terms of technical as well as economical performance. They must indeed satisfy multiple requirements: firstly structural, and also be airtight as well as watertight, thermal as well as acoustic insulation, ventilation, lighting and sun protection, safety in case of a fire, etc.

It is known from patent application FR3011863 prefabricated devices made of composite material that makes it possible to manufacture façades, for new constructions as well as for rehabilitation. These prefabricated devices have the form of hollow caissons that are combined to form a wall of a construction of a building. They make it possible to incorporate architectural and environmental performance functionalities (of the solar collector type), while still minimising the cost prices and the impact on the environment (carbon footprint at construction or at deconstruction).

This known device can be improved. Indeed, the combining of modules of prior art together is possible only according to one dimension, and this combining is carried out by a complicated nesting system.

OBJECT OF THE INVENTION

The invention proposes a construction element that is considerably improved, comprising at least one module able to be combined with other modules in a simplified manner, according to two dimensions, and on which can be integrated multiple architectural and environmental performance functionalities. The construction element according to the invention thus allows for a high degree of automation, integration, modularity and adaptability to the constraints of each structure, a personalisation and integration into the sites and local architecture.

The invention relates to a construction element comprising at least one module with a rectangular parallelepiped shape, hollow and made of a composite material, said module being delimited by an enclosure with four panels, two first opposite parallel panels and two second panels perpendicular to said first panels.

According to the invention, the second panels comprise at least one groove parallel to the first panels and each second panel is extended on one side by an L-shaped profile and on the other side by a flat profile, the profiles being elements protruding outwards, parallel to the groove.

The groove is preferably straight and extends over the entire length of the second panel.

The term "construction element" means an element that is essential to the construction of a wall, of a wall forming a portion of this wall, of a floor, of an extending floor of the balcony type, but also a structural roofing element and/or roof-terrace.

The term "made of composite material" relating to an element in the rest of the description, means the manufacturing of this element from one or from several composite materials. A composite material is a material with a base of plastic material(s) and reinforcing material(s).

According to a characteristic of the invention, the construction element is modular, i.e. it comprises a plurality of modules.

The module is advantageously open at the two opposite ends of the enclosure, said ends being called open faces.

In an embodiment, one of these two open faces is hermetically closed by a panels called a cover.

In another embodiment, the two open faces are hermetically closed by panels called covers.

Thus, at least one of the two open faces is hermetically closed by a cover.

In the rest of the description, the open faces can be closed by a cover.

According to a characteristic, the cover comprises at least one groove perpendicular to the second panels.

Preferably, each open face of the module of the invention is hermetically closed by a cover, with only one of the two covers comprising grooves perpendicular to the second panels.

In an embodiment of the invention, the construction element comprises at least two modules joined together in a sealed manner by their second panels, comprising at least one groove, said modules fitting together thanks to at least one seal housed in the adjoining grooves of said panels.

In this embodiment, the adjoining profiles are able to be glued, screwed or riveted together.

Other connection solutions of the profiles together can be considered such as extended seals.

In another embodiment of the invention, the construction element comprises at least two modules superimposed or joined together in a sealed manner by their open faces, said faces being hermetically closed by a cover comprising at least one groove perpendicular to the second panels, the grooves of each adjoining cover being symmetrical and able to house a seal in such a way as to allow for the sealed superposition or joining of the modules.

In this embodiment, the cover forms an interface part for the fastening of the modules together.

The grooves of each cover advantageously extend the grooves of the second panels of the modules.

More particularly, in this embodiment, each open face is hermetically closed by a cover.

In a preferred embodiment, the construction element comprises several modules joined together in a sealed manner by their second panels and superimposed or joined together in a sealed manner by their open faces, said faces being hermetically closed by a cover comprising at least one groove, with the seal being provided by at least one seal housed in the grooves of the second adjoining panels and of the superimposed or adjoining covers.

The seals form means of sealing.

The cover is advantageously made of composite material, preferably from the same material as the module. It thus procures the same advantages as the module, described in the rest of the text.

Preferably the cover is integrated into the module during the manufacture thereof.

The cover is used mainly to close off the openings of the module. It can also be used to form an interface part for the fastening of the module to a receiving surface of the floor slab type during the construction of a wall.

By being hollow, the modules advantageously make it possible to directly house means of insulating the thermal and/or acoustic type, without having to add them in a complex manner on the outside or inside of concrete panels or call upon multiple means of fastening in order to create sandwich panels with a light structure.

The module houses means of insulation of the thermal and/or acoustic type in its cavity.

The module is preferably hermetically closed in its two open faces by a cover, in such a way as to protect the insulation located inside the module.

In an alternative according to which the cover is integrated into the module and coming from the method of manufacturing of the module, the means of insulating are integrated in the factory.

The insulation is protected from humidity (the dew point is located outside of a wall that is rendered entirely sealed), but also from insects or rodents and thus makes it possible to use insulation that has not been used until now (bulk material waste, sensitive or fragile products, etc.)

According to the nature of the insulation, the latter can be introduced in bulk into the interior volume of the module.

Consequently, the module of the invention also has a thermal and/or acoustic insulation function comprising in its interior volume an insulating material.

The module advantageously comprises reinforcing elements, of the rib type or internal partitions.

In the alternative according to which the module comprises at least one internal partition, the latter is preferably parallel to the first panels and able to create several compartments in said module.

The partition is a single block with the rest of the module by coming from the manufacture of said module. It can also be added according to technical requirements.

The partitions contribute to the mechanical rigidity of the module.

It is possible to add against the profiles, an aesthetic and/or functional structure. It is possible to mention as an added structure, in a manner that is in no way limiting, components for the capturing and recovering of renewable energy, photovoltaic panels, various cladding panels, woodwork, glazed portions, claddings of active façades called "double skin" comprised of glass and of a network of fluids, water or air forming thermal solar collectors, systems for conveying fluids and electrical networks, information systems, indoor decorative elements, planting systems, balconies, pergolas, sun blinds and other façade accessories that preferably integrate energy recovery systems.

With regards to the capturing and the recovering of renewable energies, the profiles make it possible to impose a space between the module and the added structure, procuring for example a useful volume for the ventilation in the case of attaching photovoltaic panels (with this improving their yield). Means for recovering the hot air circulating in this volume can advantageously be combined with the device of the invention, for example in order to redistribute this hot air inside the building.

The construction element can cooperate, by way of example, on the façade, with photovoltaic modules directly attached onto the profiles, with the space separating the photovoltaic modules of said modules forming a volume that is adapted to the ventilation of the photovoltaic modules.

Alternatively, the device can comprise on the façade an innovative system for recovering thermal solar energy comprising:

- A glazed wall fastened outside and at a distance from the modules via the profiles, forming means of fastening;
- A receiver arranged in the space that separates the glazed wall from the modules, the receiver, advantageously of a dark colour, being able to capture the heat and formed by a conductive material (profiles or plates made of steel, aluminium, terracotta, etc.). This receiver is then radiated by the sun, resulting in an increase in the temperature of the air between the glass and the module.

A pivoting device of the type with shutters, opening on the one hand onto the separating space between the module of the invention and the photovoltaic modules or the glazed wall, and on the other hand on the inside of the building or the outside environment, allows the hot air to be evacuated on one side or the other of the façade, i.e. either towards the inside of the building ("winter" operation), or towards the outside in order to avoid overheating in the summer.

A solar collector is therefore very advantageously integrated into the construction element and makes it possible to recover the hot air delivered behind the glazed wall or by the photovoltaic modules during substantial sunshine.

Advantageously, an automatic regulation device, according to the inside and outside temperature readings and needs, to blow hot air into the building or then to exhaust it towards the outside.

The aforementioned pivoting device with shutters is preferably made of an insulating composite material, in such a way that it also offers the same advantages as the module.

Furthermore, various electrical cables or other functional sheaths that it is useful to convey in a construction can be housed in this space between the module and the added structure.

Alternatively, the cable or various sheaths are housed in the module.

The profiles are made of a composite material integrated into the module. They advantageously come from the "single block" method of manufacturing of the module.

In this way, the module can receive an added structure, without generating thermal bridges, without the risk of corrosion or rotting, as indicated in the rest of the text.

The module can receive different structures according to the shape of the profiles as an L or flat, which generates a large degree of flexibility. Indeed, the flat profiles advantageously make it possible to vary the space between the module and the added structure thanks to the fastening of said structure by the intermediary of fastening parts such as brackets.

The construction element according to the invention is a complete constructive system.

For vertical walls, and subject to a few adaptations, it can be used:

To create lintels and more broadly edgings of woodwork or glazed portions;

As posts, to for transferring localised high loads downwards;

As a load-bearer directly in contact with the foundations.

For a use as a floor or balcony, the construction element has a very interesting intrinsic rigidity. It can then be coupled to other materials, whether on the surface for the "ground" function", but also advantageously to concrete or light concrete, in order to improve its support and the acoustics between floors.

For use as roofing, the construction element requires a particular treatment of the junctions by adding seal covers or better yet, a sealing sheet over the entire surface thereof.

The fastening of woodwork and other particular points of the façade is facilitated by the use of the construction element according to the invention.

The woodwork can be mounted directly on the enclosure of the module.

Alternatively, profile edgings, advantageously made of composite material, can be used to form "pre-frames" which allow for the easy installation of any type of woodwork. The threshold of the doors will be particularly interesting to treat thus, likewise as the window sills.

These profile edgings are combined with the modules and maintain a high degree of impermeability to air and global thermal insulation of the whole.

In the end, the construction element of the invention, thanks to its system of modules and of profile edgings made of composite material, makes it possible to:

Propose a total cost (tools, materials, installation, maintenance) for the permanent construction which is lower than that of constructions made from conventional materials. The elements of the device made of composite material are prefabricated in the factory, according to manufacturing processes that are precise and reproducible, allowing for an implementation that is simple, fast, and effective on the construction site, and with great reliability, Meet the increased current requirements in terms of thermal insulation of the wall and of the façades thus constructed, and son corollary in terms of economical and environmental performance in the broad sense of the term.

The module made of composite material, and more precisely the elements made of composite material of the construction element (in particular the profiles), are obtained by moulding, extrusion, or preferably by pultrusion.

The composite material comprises for example at least one plastic material preferably thermosetting and fire resistant such as those used with polyester resin or fire-retardant acrylic base, and able to be reinforced by fibres such as glass fibres, basalt or plant fibres.

The composite material can ideally be woven, with fibre orientations in the longitudinal axis of the profiles, but also transversal ideally at about 45° in order to improve the resistance to shearing in certain zones dedicated to the fasteners The composite material makes it possible via the known manufacturing methods to create parts that are preferably single block with desired shapes and sizes, in particular of large dimensions, and at least cost. Thus, the construction element made from composite material of the invention procures a part that can be of large size, preferably equivalent at least to the separation height of two floor levels or even larger and as prefabricated is thus ready to be implemented. The construction element of the invention procures in particular an increase in productivity on the construction site.

The invention also relates to a construction comprising a construction element such as described hereinabove, characterised in that the profiles are made of a composite material integrated into the module and coming from the method of manufacturing of the module, and in that an aesthetic and/or functional structure, such as a cladding system, is added on the profiles.

The construction advantageously comprises electric cables or other functional sheaths housed between the profiles.

BRIEF DESCRIPTION OF THE FIGURES

This invention is now described using examples that are solely for the purposes of information and in no way limiting of the scope of the invention, and using the accompanying illustrations, wherein.

DETAILED DESCRIPTION OF EMBODIMENTS OF THE INVENTION

In the rest of the description, the qualifiers "outer" and "inner" relating to the module are understood respectively by what faces the outside environment and is located inside the module.

In regard to FIGS. 1 to 9, the terms "horizontal", "vertical", "upper", "lower", are understood as qualifying elements of the module when the latter is arranged to form a wall, with respect to a flat horizontal ground, and the terms "height", "width" and "thickness" of the module respectively correspond to the vertical, horizontal dimensions extending along the length of the wall unit to be constructed, and horizontal forming the thickness of the wall unit and separating the inside from the outside of said wall.

The Figures are not to scale in order to facilitate the reading thereof.

Figure 1:
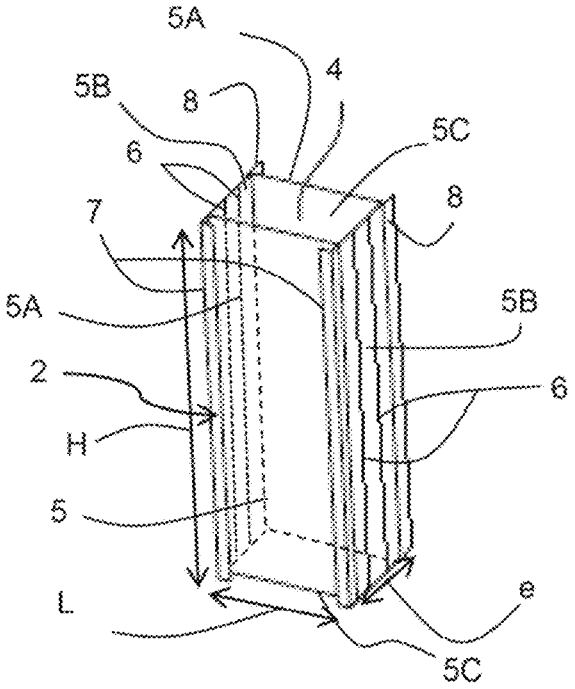
FIG. 1 shows a perspective view of a module of a construction element according to the invention.

The invention relates to a construction element 1 that has the form of at least one module 2 such as shown in FIG. 1.

The construction element 1 is intended to form a wall 3 (FIG. 4) of a building construction.

The module 2 is hollow and has a substantially rectangular parallelepiped shape. It is delimited by an enclosure 5 which defines a cavity 4.

The enclosure 5 is formed from two first opposite parallel panels 5A and two second panels 5B perpendicular to said first panels 5A. The first and second panels 5A and 5B correspond to four faces of the rectangular parallelepiped.

The two other faces of the rectangular parallelepiped are open. They are called open faces 5C.

The width L of the module 2 can be variable. The width is for example 300 mm or 600 mm. Different widths can be considered.

The height H of the module 2 can also be variable. The height is for example from 0.1 m to 15 m and preferably about 12 m.

The thickness "e" of the module is for example 240 mm. It can vary from 100 to 350 mm, this according to the expected performance.

The thickness of the enclosure 5 of the module 2 is for example about 5 mm. It can vary according to the objectives sought, with the integration into the composite material of other types of elements or materials, such as described in what follows.

Figure 4:
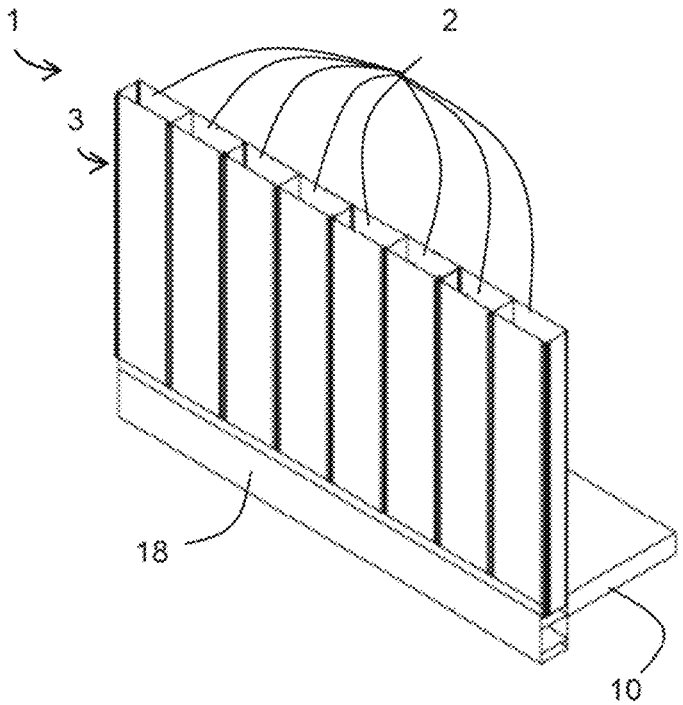
FIG. 4 is a perspective view of a construction element of the invention integrating a plurality of modules in order to form a wall.

Several modules 2 are intended to be joined together by their second panels 5B, as shall be seen with regards to FIG. 4.

Figure 6:
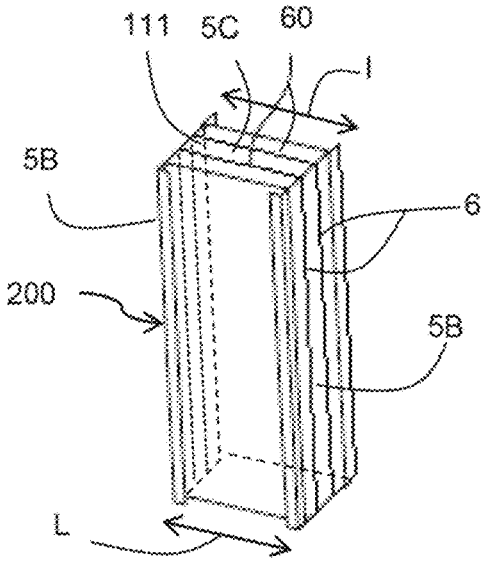
FIG. 6 shows a module according to FIG. 5 with another type of cover.

Alternatively, several modules 2 are intended to be superimposed by their open faces 5C, as shall be seen with regards to FIG. 6.

In an embodiment of the invention not shown, several modules 2 are intended to be both joined by their second panels 5B, and superimposed by their open faces 5C.

The module 2 of the invention comprises, integrated into the enclosure 5 and arranged on each one of its second panels 5B, two grooves 6, extending over the entire height of said panels 5B, parallel to the first panels 5A.

In addition, each second panel 5B is extended on one side by an L-shaped profile 7 and on the other side by a flat profile 8; the profiles 7, 8 being elements protruding outwards, parallel to the grooves 6. Other more specific geometries can be considered according to the cladding to be added.

Each profile 7, 8 extends the thickness of the module 2 from 1 to 10 cm.

The term "outside", means the environment outside the module, contrary to the inside cavity.

The L-shaped profiles 7 extend the second panels 5B of one side, which the flat profiles 8 extend the second panels 5B of the other side.

Thus, the profiles 7, 8 extend the second panels 5B in a direction perpendicular to the first panels 5A.

The depth of each groove 6 is about 1 to 3 mm.

Each groove 6 is able to house a seal 12 (visible with regards to FIG. 3) of which the thickness is greater than the depth of said groove 6. Thus, the depth of the grooves varies according to the seal selected.

The profiles 7, 8 are intended to add a façade coating with an aesthetic and/or functional function. They are also called means of fastening.

The profiles 7, 8 are an integral part (via the method of manufacture) of each module 2.

Figure 3:
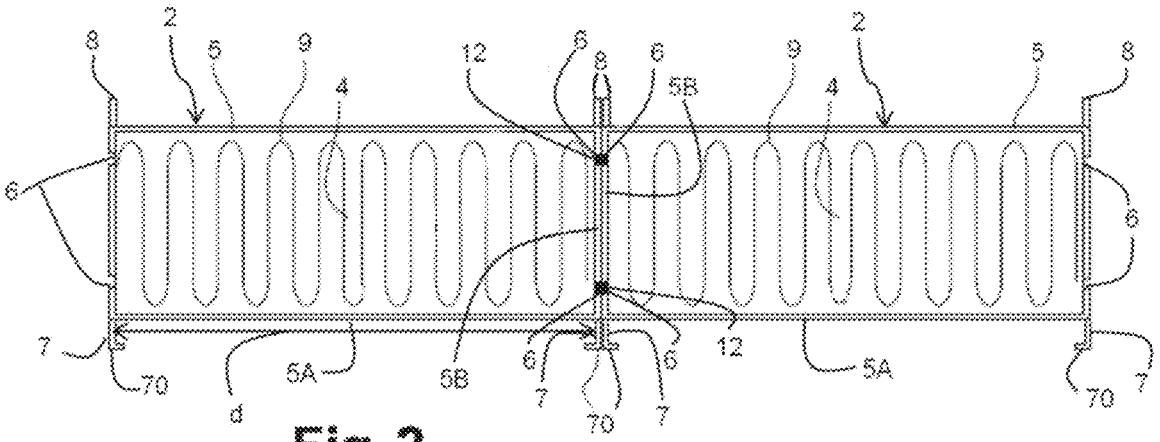
FIG. 3 shows a top view of an embodiment of juxtaposition of two modules according to FIG. 2, of the insulating material being introduced into the modules.

These profiles 7, 8 shall be described in more detail with regards to FIG. 3.

The module 2 is made of composite material. Here, the composite material preferably comprises a single plastic material, in particular a thermosetting and fire-resistant material such as acrylic or polyester, flame retardant; as well as reinforcing fibres of the glass, basalt type or other fibres of mineral or synthetic origin or even fibres of plant origin.

Other plastic materials and/or reinforcing fibres can be used without leaving the scope of the invention. It is possible to insert for example into the composite material other materials or products for new functionalities (heating fabrics made of carbon fibres or metal mesh), materials that are particularly interesting for shielding (aramid fibres), identification systems of the RFID type (to track products), or sensors embedded in the composites (in order to measure the deformations of the product, its temperature or any other physical parameter).

The module 2, is manufactured by moulding, or by extrusion, in particular when the reinforcing fibres are short, or by pultrusion when the fibres, mats and/or fabrics are continuous.

Figure 2:
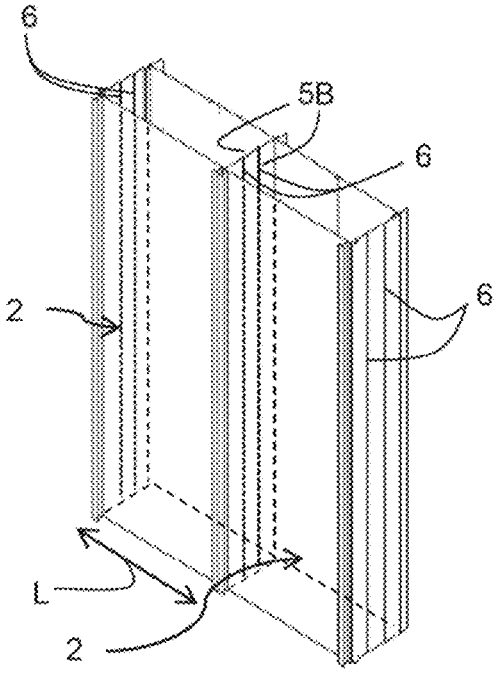
FIG. 2 shows an embodiment of juxtaposition of two modules for the purpose of forming a wall.

FIGS. 2 and 3 show two modules 2 joined together in a sealed manner by their second panels 5B. A seal 12 (FIG. 3)

makes it possible to combine the modules 2 in a sealed manner. Said seal 12 bears against each groove 6 of the second adjoining panels 5B.

The grooves 6 and the seals 12 cooperate in order to combine in a sealed manner the modules 2. Each seal 12 is able to be housed in the grooves 6 of two adjoining modules 2 so as to combine in a sealed manner said modules 2. This is referred to as mutual means of cooperation via nesting of two adjacent modules.

The seals 12 are housed at the interface of two adjoining modules 2.

The thickness of the seals 12 is duly chosen to provide an optimal crushing of the seal. This thickness is advantageously equal to twice the depth of the groove 6.

The width L of each module 2 is identical. However, in an alternative not shown, each module 2 can be of a different width, supplying a modularity in width to the construction element.

Moreover, the modules 2 are able to be cut in their width L in order to obtain modules 2 of a specific width. A panel identical to the second cut panel 5B will then be reglued in a sealed manner on the open side of the module 2 in order to reform a hollow module.

FIG. 3 further shows that the modules 2 are intended to house an insulating material 9, for example glass wool or polyurethane foam, in their cavity 4. The incorporation of the material 9 is carried out either in the factory, for example by being injected into the cavity 4 of said modules 2, or on site, for example by being introduced in the form of panels of which the volumes correspond to the cavity 4 of the modules 2.

One of the advantages of the construction element 1 of the invention is to be able to receive any type of insulation 9.

By way of examples of insulation that are in no way limiting, mention can be made of:

- mineral fibres such as glass or rock fibres,
- plant materials of the fibre type or wood chips, bark, straw, hemp,
- synthetic foams such as polyurethane or polystyrene, having an expanded form or in beads, even recycled as chips,
- animal wools or feathers,
- mineral beads of granules (vermiculite, glass beads, expanded clay, volcanic rock),
- recycling products such as recycled crushed glass, cellulose or plastic fibres, and in all forms (wools, foam, beads, bulk, chips, rigid or semi-rigid panels).

The modules, which are hollow, also make it possible to receive a large number of phase change materials such as paraffin, polymer, fatty acid, etc., that thus make it possible to improve comfort in the summer.

In these terms, the invention offers a high degree of freedom of choice to the principal or general contractor according to the sought performance (technical, economical, environmental), and this in all climates.

The construction element 1 is thus thermally as acoustically insulating.

Thus, the modules made of composite material of the invention provide single-block structures that preferably integrate the insulation functions when the modules are already filled in the factory with insulating material. These modules are ready to use and make it possible to construct a wall such as shown in FIG. 4.

The L-shaped profiles 7, protruding outwards from each module 2, have a return 70 parallel to the first panels 5A, said returns 70 being facing, turned toward one another.

So-called added structures (not shown), such as photovoltaic panels, are advantageously fastened to the returns 70, on the outside, of the modules 2 via fastening means.

The space between the L-shaped profiles 7 and the closest first panel 5A, forms a volume that is suitable for the ventilation of photovoltaic panels.

Parietodynamic sensors of the hot air or water sensor type take space in this space.

They are an integral part of the construction element of the invention and allow the construction element to recover on the surface more energy than it expends via heat loss.

Alternatively, other added structures such as finishing elements can be fastened to the returns 70, on the outside, of the modules 2.

Figure 10:
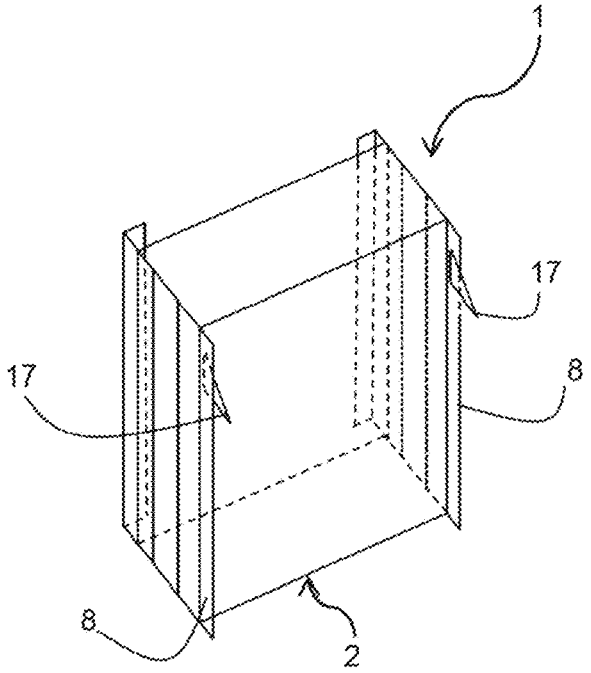
FIG. 10 shows a construction element according to the invention comprising fastening parts for an added structure.

The flat profiles 8 do not have a return. Added structures can also be fastened to these flat profiles 8, either directly on the inner face (turned towards the flat profile of the same module) of said profiles, or by the intermediary of fastening parts such as brackets (FIG. 10). In this way, the space between the module 2 and the added structures can vary according to the dimensions of the intermediate part. This space varies for example between 0 and 40 mm.

Thus, the module 2 can receive different structures according to the form of the profiles as an L or flat, which generates a large degree of flexibility.

As shown in FIG. 4, the construction element 1 is combined with the floor 10, generally formed from a concrete slab, of the construction so as to form a wall 3, by the intermediary of a connection module 18.

It rises from the floor 10 to the ceiling (not shown), or when there are several floors, extends over the separation height of two floors, between the floor of one and the ceiling of the upper floor.

Alternatively, this combination is done directly as slab nosing, by the intermediary of special fastening brackets, attached on the L-shaped or flat profiles.

In an embodiment not shown, specific devices that make it possible to limit the propagation of flames are arranged against the enclosure 5 of the modules 2, on the connection between the modules 2 and the floor 10 and/or the level of passage of opening items such as described in what follows.

Figure 5:
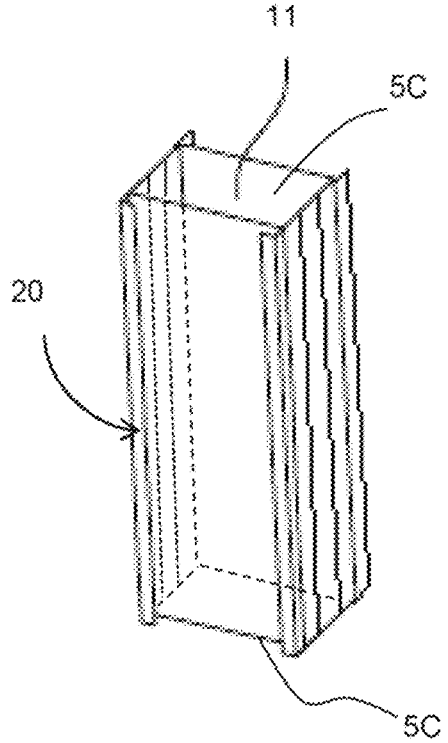
FIG. 5 shows a module according to FIG. 1, comprising a cover.

FIG. 5 shows a module 20 identical to the module 2 of FIG. 1 but comprising a cover 11 which hermetically closes, preferably by gluing, one of its open faces 5C.

Preferably the cover 11 is also made of a composite material, for example from the same material as that of the module 20.

The cover 11 can make it possible to fasten the module 20 to the floor of a construction. In this case not shown, each module 20 is affixed against the floor by the intermediary of the cover 11, by interfacing preferably a fire barrier element between the cover 11 and the floor.

FIG. 6 shows a module 200 that is substantially identical to the module 20 of FIG. 5 but of which the cover 111 comprises grooves 60 extending over the entire length l of said cover 111 (the length l corresponding to the width L of the module 200) in such a way as to protect the grooves 6 of the second panels 5B of the module 200.

The module 200 can also comprise a cover 11 on one of its open faces 5C and a cover 111 with grooves 60 on the other open face 5C.

Figure 7:
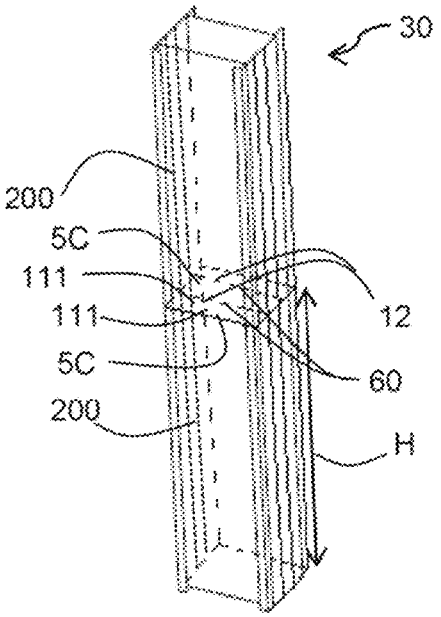
FIG. 7 shows an example of superposition of two modules for the purpose of forming a wall.

FIG. 7 shows two modules 200 that are superimposed in a sealed manner.

Each module 200 comprises a cover 111 provided with grooves 60, on its adjoining open faces 5C.

A seal 12 is housed in the grooves 60 of the covers 111 in such a way as to combine the modules 200 in a sealed manner. The seal 12 bears against each groove 60.

The grooves 60 of the covers 111 and the seals 12 cooperate in order to combine in a sealed manner the modules 200. This is referred to as means of mutual cooperation by nesting of two superimposed modules.

The seals 12 are housed at the interface of two superimposed modules 200.

In the same way as for the grooves 6 of the second panels 5B, the depth of the grooves 60 of the covers 111 varies according to the seal 12 selected. The thickness of said seal is advantageously equal to twice the depth of the groove 60. This thickness is duly chosen in order to provide an optimal crushing of the seal during the superposition of two modules 200.

The superimposed modules 200 make it possible to form a wall 30. According to the desired height of the wall, the same heights of modules or different heights can be combined.

The height H of each superimposed module 200 is identical.

Alternatively, the height H of each superimposed module 200 could be different, supplying a modularity in height to the construction element 1.

In the same way as hereinabove, the modules 200 are able to be cut in order to obtain a module of specific height. A cover 111 can then be reglued in a sealed manner on the cut side in order to reform a hollow module 200 according to the invention.

Figure 8:
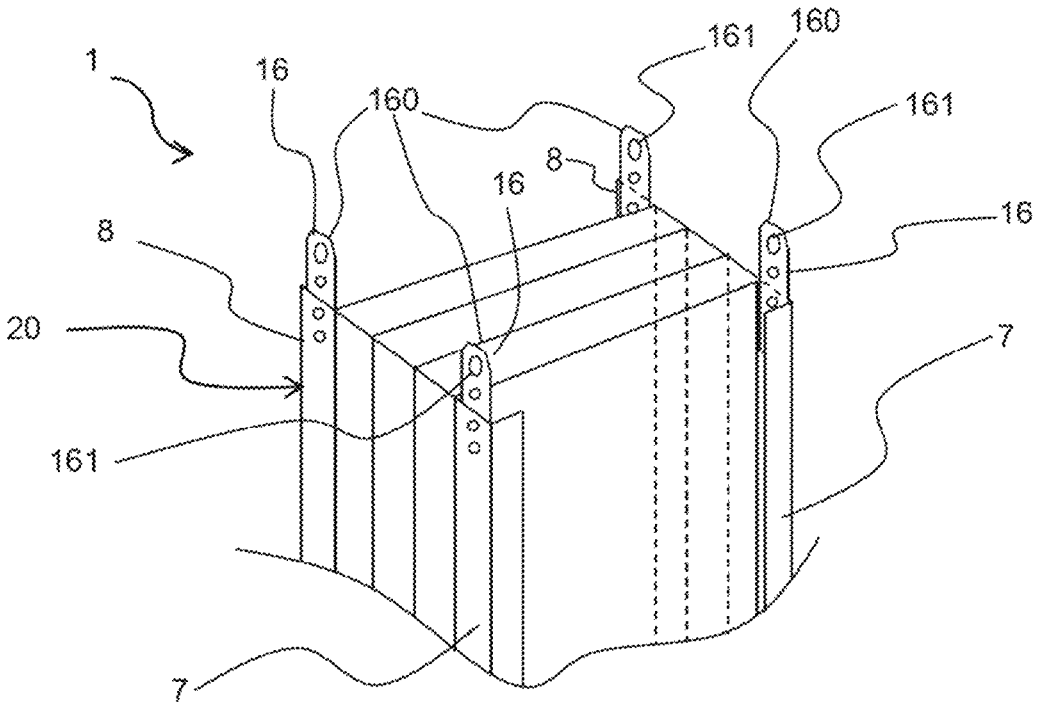
FIG. 8 shows a construction element according to the invention comprising splice bars intended to connect two superimposed modules.

Moreover, as shown in FIG. 8, the module 200 advantageously comprises metal splice bars 16 positioned against the L-shaped profiles 7, on their facing faces, and against the flat profiles 8, on their facing faces. The splice bars 16 extend beyond said module 20, in height, in such a way as to also be able to be positioned against the corresponding profiles 7, 8 of the superimposed module 200 (not shown in FIG. 7).

These splice bars 16 make it possible to mechanically link the superimposed modules 200, together and to facilitate the aligning (the centring) of the superimposed modules 200 by the introduction of "input" chamfers 160 of said splice bars in the corresponding profiles 7, 8 of the superimposed modules.

Furthermore, the splice bars 16 comprise rings 161 intended to allow for the slinging of modules.

Figure 9:
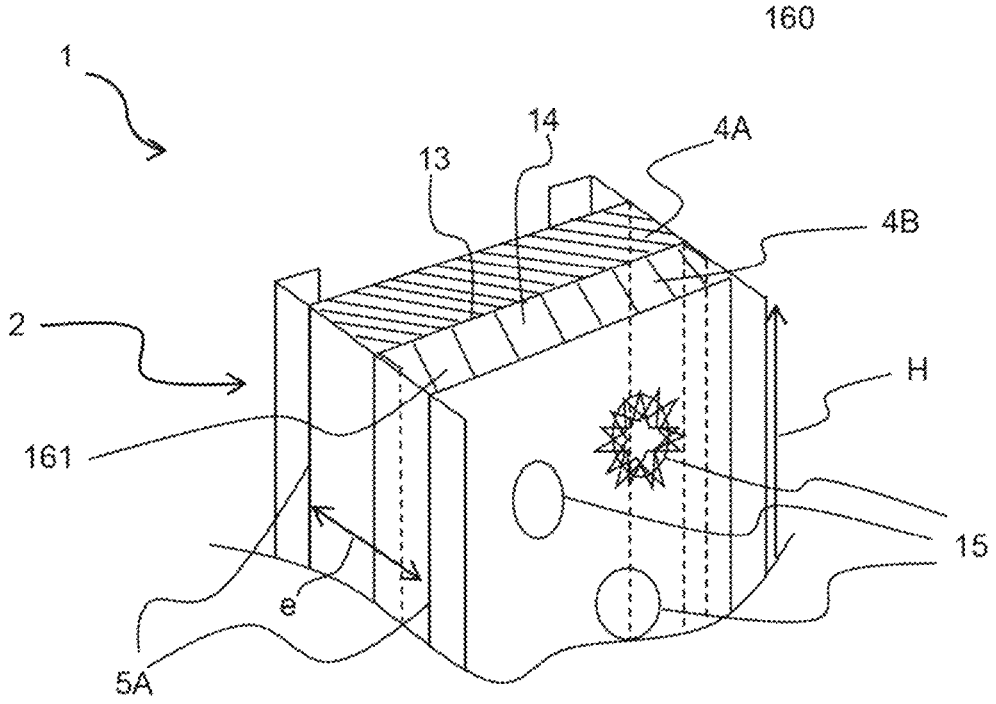
FIG. 9 shows an example of a construction element according to the invention comprising a module comprising an internal partition and intended to receive a plant structure.

In an alternative shown in FIG. 9, the module 2 comprises reinforcement elements 13 in its cavity 4, in such a way as to rigidify the structure. These reinforcing elements 13 are integral with the cavity 4 of the module, such as partitions.

The partitions 13 extend preferably according to the height H of the module 2, parallel to the first panels 5A, forming compartments 4A and 4B. According to the dimension of the thickness "e" of the module 2, the latter can comprise at least one partition 13 then forming two compartments 4A, 4B.

These added and sealed partitions will also make it possible to introduce into the module a substrate 14 for direct planting. In this embodiment, the first panel 5A in contact with the substrate 14 comprises holes 15 that make it possible to prick out plants.

In an alternative not shown, the module could, in a combined manner or not, integrate into the enclosure 5 reinforcing elements, such as ribs.

FIG. 10 shows a construction element 1 such as described in regards to FIG. 1, further comprising brackets 17 fastened on the flat profiles 8. These brackets 17 are fastening parts that make it possible to fasten an added structure (not shown) and to choose the distance between the module 2 and the added structure (not shown).

Figure 11:
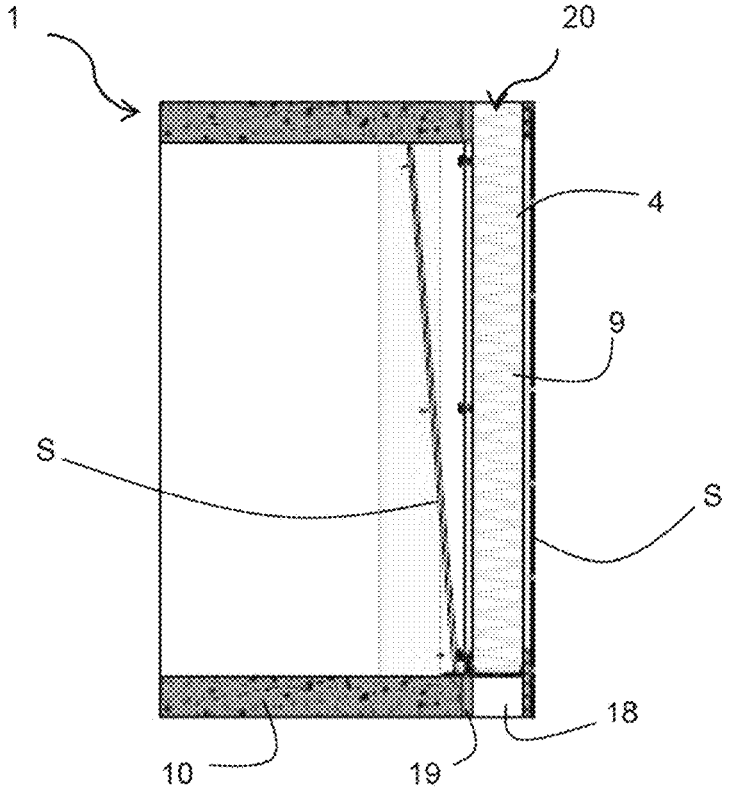
FIG. 11 is a cross-section side view showing the implementation of a construction element according to the invention.

The implementation of a construction element 1 according to the invention in order to create a wall is done in the following way, with regards to FIG. 11.

On site, the module 20, comprising a cover 11, is fastened to the concrete slab 10, by the intermediary of a connection module 18. This fixation is carried out thanks to fastening devices (not visible) which, on the one hand are embedded in the concrete slab 10 and on the other hand cooperate via bolting with the cover 11 and the connection module 18.

The fastening devices comprise an adjustable metal part to overcome the defects in terms of flatness of the nose (tranche) of the slab 10. Said part provides the fastening of the module 20 to the slab 10 in such a way as to guarantee an alignment of the module according to the plane of the façade of the construction.

The space between the modules and the slab nose is filled in by a specific firewall device 19 (rock wool and metal sheet for example).

Modules 20 are then laterally nested thanks to the presence of seals 12 housed in the grooves 6 of the second adjoining panels 5B of two adjoining modules 20, such as shown in FIG. 3.

The steps of fastening to the slab and of nesting of the modules are carried out simultaneously thanks to the simple structure of the means for mutual cooperation by nesting of two adjacent modules (groove and seal). Thus, a plurality of modules 20 is arranged to form the desired length of the wall.

With the purpose of carrying out a wall with a height greater than the height of a module 20, other modules according to the invention are superimposed by nesting one into the other thanks to the presence of covers 111 comprising grooves 60 able to house the seals 12, on the superimposed open faces of the superimposed modules, such as described with regards to FIG. 3. Thus, a plurality of modules is arranged to form the desired height of the wall.

Preferably, the modules 20 already incorporate an insulating material 9 in their cavity 4, before they are set in place to form the wall.

Then, an added structure S is set in place against the outer and inner façade of the modules 20. The added structure S is fastened to the returns 70 of the L-shaped profiles 7 thanks to fastening means (FIG. 3), while it is fastened to the flat profiles 8 by the intermediary of fastening parts such as brackets 17.

Thus, the shape of a module makes manufacturing a wall easy and fast. Indeed, the modules can be nested into one another laterally and/or vertically.

The modules can be, as expressed hereinabove, of different sizes (in particular height and/or width) which makes it possible to treat in particular all of the widths and heights of wall units according to the layout constraints that are proper to each structure. For example, the modules can have widths of 100, 200 or 600 mm, and all multiples of 600 (1200 mm, etc.), and heights from 0.10 to 6 m (even more subject to what can easily be transported on the construction site), thus procuring substantial flexibility on the outside dimensions of the walls to be manufactured.

This is very useful for carrying out lintels which are made structural by gluing and bolting.

The module is able to be cut in precise zones in order to bend it to create for example curved walls.

Furthermore, it is easy to manufacture large sizes, providing large-size modules, which facilitates fast mounting on the construction site and which maximises productivity on the construction site. The implementation decreases the arduousness of the work on the construction site.

The modules made of composite material of the invention provide single-block structures that preferably integrate the insulation functions when the modules are already filling in the factory with an insulating material. These modules are ready to use and make it possible, combined with closing profiles which are advantageously made from composite material, to construct a wall, in particular of a building, quickly, at least cost, avoiding thermal bridges and complying with the energy construction standards concerning fire.

Finally, the modules can be, ideally carpentered, but otherwise recut to create holes in the wall unit and embed elements such as door or windows.

On the cuts, are intended to be added profile edgings made of composite material, with a geometry suitable for being thrust against the cutouts and to close the portions open to the inside of the module. Once the profile edgings are added, they arrange in the wall unit made of cut modules a location for housing and fastening a window for example. The profile edgings advantageously form a fastening frame for the window. These steps can be carried out in the factory or on site.

The modules can easily conform to any type of architecture, whether for being added to an existing structure, but also for creating slight curves, even without any specific tools.

Thus, the prefabricated construction device of the invention is also a complete wall of the "mantel wall" type. It comprises at least one module made of composite material. The abutment of several modules forms the wall. The modules make it possible to combine therein additional accessories in order to add therein all of the usual functions of a façade (opening items, balconies, aesthetic or technical claddings).

The construction device of the invention reduces the overall cost of the construction and procures among other things a rapidity in implementation and a construction with ecological performance (energy performance, low grey energy, low carbon footprint).

In an alternative not shown, the module according to the invention is intended to form a floor. In this alternative, it is understood that the module is intended to be arranged horizontally, the first panels being parallel to the ground.

In the same way as hereinabove, several modules can be joined together in two dimensions (length and width) in order to form a floor.

In another alternative, not shown, a floor formed of several modules is combined with a wall formed of several modules. A cover such as described hereinabove with regards to FIG. 5, and/or a connection module, then make it possible to connect the modules together at 90°.

The invention claimed is:

1. A construction element comprising:

at least two modules, each module having a rectangular parallelepiped shape, hollow and made of a composite material, delimited by an enclosure with four panels, two first opposing parallel panels and two second panels perpendicular to the first panels, the second panels comprise at least one groove parallel to the first panels and each second panel extends on one side by an L-shaped profile and on other side by a planar profile, the profiles being elements protruding outwards, parallel to said at least one groove and extending the second panels in a direction perpendicular to the first panels;

wherein said each module is hermetically closed at least one of opposite ends of the respective enclosure by a cover, the cover comprising at least one groove perpendicular to the respective second panels and the opposite ends being called open faces; and wherein said at least two modules are superimposed or joined together in a sealed manner by their respective open faces, the open face of said each module being hermetically closed by its respective adjoining cover, each adjoining cover comprising said at least one groove perpendicular to the respective second panels, and the grooves of said each adjoining cover being symmetrical and configured to house a seal to enable the sealed superposition or joining of said at least two modules.

2. The construction element according to claim 1, wherein each open face of said each module is hermetically closed by a corresponding cover, with only one of the two covers comprising grooves perpendicular to the respective second panels.

3. The construction element according to claim 1, wherein said each module comprising a cavity to house an insulation of at least one of thermal and acoustic type.

4. The construction element according to claim 1, wherein said each module comprises reinforcement elements, the reinforcing elements being of a rib type or internal partitions.

5. A construction comprising the construction element according to claim 1, wherein the profiles are made of a composite material integrated into said each module, the profiles are manufactured by a method of manufacturing said each module; and wherein at least one of aesthetic and functional structure is added on the profiles.

6. The construction according to claim 5, wherein said at least one of aesthetic and functional structure is a cladding system.

7. A construction element comprising:

a plurality of modules, each module having a rectangular parallelepiped shape, hollow and made of a composite material, delimited by an enclosure with four panels, two first opposing parallel panels and two second panels perpendicular to the first panels, the second panels comprise at least one groove parallel to the first panels and each second panel extends on one side by an L-shaped profile and on other side by a planar profile, the profiles being elements protruding outwards, parallel to said at least one groove and extending the second panels in a direction perpendicular to the first panels;

wherein said each module is hermetically closed at least one of opposite ends of the respective enclosure by a cover, the cover comprising at least one groove perpendicular to the respective second panels and the opposite ends being called open faces; and wherein said plurality of modules joined together in a sealed manner by their respective second panels and superimposed or joined together in a sealed manner by their respective open faces, the open face of said each module being hermetically closed by its respective superimposed or adjoining cover, each superimposed or adjoining cover comprising at least one groove, and at least one seal housed in at least one of the grooves of the adjoining second panels and the superimposed or adjoining covers providing the sealed superposition or joining of said plurality of modules.

8. The construction element according to claim 7, wherein each open face of said each module is hermetically closed by a corresponding cover, with only one of the two covers comprising grooves perpendicular to the respective second panels.

9. The construction element according to claim 7, wherein said each module comprising a cavity to house an insulation of at least one of thermal and acoustic type.

10. The construction element according to claim 7, wherein said each module comprises reinforcement elements, the reinforcing elements being of a rib type or internal partitions.

11. A construction comprising the construction element according to claim 7, wherein the profiles are made of a composite material integrated into said each module, the profiles are manufactured by a method of manufacturing said each module; and wherein at least one of aesthetic and functional structure is added on the profiles.

12. The construction according to claim 11, wherein said at least one of aesthetic and functional structure is a cladding system.

* * * * *